US006557898B2

(12) United States Patent
Kissinger et al.

(10) Patent No.: US 6,557,898 B2
(45) Date of Patent: May 6, 2003

(54) DEVICE, SYSTEM AND METHOD FOR LABELING THREE-DIMENSIONAL OBJECTS

(75) Inventors: Candice B. Kissinger, West Lafayette, IN (US); Patrick D. Mullen, Delphi, IN (US); Scott R. Peters, West Lafayette, IN (US); Jonathan D. Combs, West Lafayette, IN (US)

(73) Assignee: Bioanalytical Systems, Inc., West Lafayette, IN (US)

( * ) Notice: Subject to any disclaimer, the term of this patent is extended or adjusted under 35 U.S.C. 154(b) by 0 days.

(21) Appl. No.: 09/804,900

(22) Filed: Mar. 13, 2001

(65) Prior Publication Data

US 2002/0129525 A1 Sep. 19, 2002

(51) Int. Cl.[7] ..... B42D 15/00

(52) U.S. Cl. ..... 283/70; 283/79; 283/81; 40/310

(58) Field of Search ..... 283/79, 80, 81, 283/74, 75, 101, 105, 111; 40/299, 309, 310, 321

(56) References Cited

U.S. PATENT DOCUMENTS 2,961,715 A * 11/1960 Morin ..... 18/59
5,242,053 A * 9/1993 Rowe ..... 206/446
5,894,733 A * 4/1999 Brodner ..... 62/51.1

* cited by examiner

*Primary Examiner*—Willmon Fridie, Jr.
(74) *Attorney, Agent, or Firm*—Doreen J. Gridley, Esq.; Alexander D. Forman, Esq.

(57) ABSTRACT

A device, system, and method for labeling three-dimensional objects. A sheet comprising at least one tag, each tag consisting of a thin piece of resilient, print-treated polyester, or other material, and a method of attaching the tag to a three-dimensional object, such as a glass or plastic vial, is described. The tag identifies each individual object, and permits transfer of the object throughout a series of analytical processes without losing object identity. The tag is marked by offset printing, laser engraving, or another marking process such that the marking does not become unreadable during handling and testing. Labeling of individual objects is accomplished by inserting an object through an aperture in the tag resulting in the tag being attached to the vial. Removal of the vial from the sheet causes the tag to be separated from the sheet and to remain attached to the vial. Alternatively, a sheet holder, such as a rack, could be used to hold the sheet of tags during the labeling process. Labeling three-dimensional objects through the use of the device, system, and method of the present invention is faster, easier, and less expensive than current labeling methods. Additionally, the engagement of the tag to the three-dimensional object withstands extreme temperature changes better than the adhesive attachment of other labels, and the tags are easier to remove than adhesive labels.

48 Claims, 14 Drawing Sheets

DEVICE, SYSTEM AND METHOD FOR LABELING THREE-DIMENSIONAL OBJECTS

FIELD OF THE INVENTION

The present invention relates to a device, system and a method for labeling three-dimensional objects, such as vials that are used in chemical analysis.

BACKGROUND

Several methods for placing identification information onto three-dimensional objects currently exist. One method utilizes an adhesive to adhere the identification information to the surface of the object, such as by attaching an identifying label. Another involves printing the identification information on the surface of the object, such as through the use of ink. The information could also be stamped into the surface of the object. Alternatively, the identification information may be etched into the surface of the object through the use of a laser or other etching tool. Another method involves placing the identification information onto a tag and tying the tag to the object.

For many three-dimensional objects, however, the currently available methods for placing identification information onto the objects are not compatible with the manner in which the objects are used in certain industries. One example of such an object is a vial used in chemical analysis. Chemical analysis involves the exposure of a sample to one or more treatments which may be used to determine the identity and/or relative concentration of constituent chemicals in that sample. Bioanalytical chemistry is one variant of this process which involves the study of samples from various, biological origins such as blood, plasma, serum, urine, tissue, bile, and cerebrospinal fluid. In some studies, large numbers of samples are generated to provide either statistical validity, or a representation of change during a dynamic process such as metabolism, which changes one chemical entity into another. Sample vials are typically small, and hold volumes on the order of 300 $\mu$L. Managing large numbers of small sample vials during a process which may involve transfer of vials to different devices, such as fraction collectors, centrifuges, autosamplers, mixers, or incubators, presents the opportunity for confusion of sample identity unless those vials are clearly labeled.

An example of a process in bioanalytical chemistry that requires clearly labeled vials is fraction collection. Fraction collection is a process which allocates fluid from a continuously flowing stream into a series of collection vessels arranged sequentially. The sequence of the collection vessels is extremely critical in several applications of fraction collection, including but not limited to, liquid chromatography, column chromatography, microdialysis sampling, automated blood sampling, and ultrafiltration sampling. The material eluting from a column, probe or other device represents a discrete series of chemical events or changes. The progress of these chemical events can be identified only through the correct sequencing of vials during subsequent analysis.

Fraction collection and the chemical analysis techniques required to analyze the collected samples rarely occur simultaneously. A normal procedure requires that samples be collected and then stored before being transferred to a separate device for analysis or further processing, such as centrifugation, heating, or freezing. Fraction collection samples are frequently collected in small, e.g. 300 $\mu$L, glass vials which may be capped and sealed before or after the collection process. These vials are loaded into an X-Y type grid or circular carousel before collection and then must be transferred to a holding device or another type of grid or carousel if they will be stored or processed for analysis. During the process of transfer, it is relatively easy for an operator to mistakenly transfer one or more vials out of the correct order or sequence. It is also possible for the operator to drop one or more vials during the transfer process, losing the sample or altering the relative order of the samples in the collection sequence.

Another process in bioanalytical chemistry that requires clearly labeled vials is autosampling. Autosampling is the "reverse" of fraction collection. During autosampling, the vials containing samples are arranged in order and then the fluid inside the vials is removed in that same sequence by the autosampler and transferred to a device such as a gas or liquid chromatograph or a mass spectrometer. Autosampling is generally done just prior to the final analysis of a material, or as part of the final analytical step. Since the correct arrangement of the vials is critical, proper sample identification is vital. Mistakes can occur since these vials are generally loaded with the sample in a remote location and during a separate process such as fraction collection, manual pipetting, or another dispensing operation.

Most methods for organizing the handling of multiple sample vials use the concept of a rack. In the rack approach vials are transferred by hand into a container which has an individual hole for each vial. These holes are typically arranged in an array of one or more rows and columns. This container or rack is then carried to the next processing step, where the vials are then either unloaded from the rack and reloaded into a different rack, or the rack itself is placed into another device so that the samples are processed in the same sequence. Obviously, the least potential for error exists in the scenario where vials are loaded into a rack, and not removed from the rack throughout the battery of analyses. However, it is rare that the user has an option of using the same rack for all steps of the process. More frequently, the fractions are collected in one rack, stored in another and finally analyzed in yet another rack. Each step requires the transfer of multiple sample vials, with the concomitant risk of dropping or misplacing samples thereby destroying the original and required sequence of vials.

The current methods of placing identification information onto three-dimensional objects are not sufficient for labeling vials used in bioanalytical chemical analysis. Using adhesive labels to apply identification information is not optimal because adhesives on labels can loosen allowing the label to detach from the vial. This detachment of the label from the vial is accelerated by freezing and or refrigeration that occurs in some bioanalytical testing procedures, as temperature changes, and condensation induced by such changes, can have a deleterious effect on adhesives. Additionally, if the identification information on the adhesive label is ink, it can become smudged and unreadable due to repeated handling and exposure to the solvents and fumes which may be used during an analytical procedure. During fraction collection, adhesive labels could critically alter test data as the labels can cant the vial to one side, ruining the critical alignment of the vial relative to a perpendicular collection cannula. Further, if the identification information on a vial needs to be changed, an additional label must be added to the vial, further affecting the alignment of the vial, or the original label must be painstakingly removed. Also, applying adhesive labels to each small vial is tedious and time-consuming.

Printing the identification information onto the surface of the vial with ink is not acceptable because the ink can become smudged and unreadable just as the ink on adhesive labels. Additionally, due to the small size of the vials and their glass or plastic construction, labeling each vial individually and legibly using a pen is a tedious and time-consuming chore. Processes such as pre-engraving, bar-coding, or stamping the identification information directly onto the vials add to the expense of each vial, require that vials be pre-arranged in order, and, depending on the process used, may not provide numbers or codes that are easily readable, or readable without a special device such as a bar-code scanner. Additionally, any identification information placed directly onto vials by processes such as these do not permit easy alteration of the information. Such alteration may be desirable, for example, to identify multiple vials as members of one group by causing the first or last symbol of the identification information on all of the vials to be the same. Tying a label to a vial is also not effective, because the material used to tie the label to the vial will likely affect the alignment of the vial and tying a label to each individual vial would be extremely time-consuming. Additionally, none of these current methods for labeling three-dimensional objects are capable of labeling multiple objects at one time.

Further, these current methods for labeling three-dimensional objects are not capable of satisfying a current need in the chemical analysis industry, namely a quick and inexpensive means of labeling vials at multiple points in the analytic process to track the progression of vials through the process. Currently, if a vial is to be tracked through various stages of a process, after each stage the identification information on the vial must be recorded. For example, if the identification information on the vial is a barcode, the barcode is scanned after each stage of the process signifying to a computer attached to the scanner that the vial has completed that stage. Alternatively, an adhesive label of a certain color could be applied to the vial after it has completed a certain stage. However, in bioanalytical testing, the addition of more adhesive labels could alter a vial's alignment. Also, neither the barcode method or the colored adhesive label method permit the marking of multiple vials at one time.

For the foregoing reasons there is a need for a relatively inexpensive device that permits quick and simple labeling of three-dimensional objects, such as vials. A device that enables easy removal of the identification information and that does not alter the alignment of the object is also needed. A further need is for a device that attaches identification information to an object such that the attachment is capable of withstanding the repeated handling and extreme temperature changes inherent in bioanalytical chemical testing. A device is needed that permits the addition of identification information to an object that is easily read, easily altered, and resistant to smudging and smearing. Additionally, there is a need for a device that is capable of labeling vials at various stages in an analytical process to permit tracking of the vial through the process.

SUMMARY OF THE INVENTION

The present invention comprises a device, system, and method for labeling three-dimensional objects. In one embodiment of the device of the present invention, the device comprises a sheet having a carrier portion and at least one tag removably attached to the carrier portion. Each tag in the device has an aperture therethrough, and the aperture is so dimensioned that an engagement may be created between the aperture and the outside surface of a three-dimensional object. The strength of this engagement is greater than the strength of the tag's removable attachment to the carrier portion of the sheet.

In another embodiment of the device of the present invention, the device comprises a sheet having two layers, a tag layer and a backing layer, lightly adhered together by a weak adhesive. The tag layer has a carrier portion and at least one tag removably attached to the carrier portion. Each tag has an aperture therethrough, and the aperture is so dimensioned that an engagement may be created between the aperture and the outside surface of a three-dimensional object. The backing layer has at least as many holes therethrough as the number of apertures in the tag layer. Each aperture in the tag layer is aligned with a corresponding hole in the backing layer. The strength of the engagement between the aperture and the three-dimensional object is greater than the combined strength of the tag's removable attachment to the carrier portion of the sheet and the adhesive attachment of the tag layer to the backing layer.

In one embodiment of the system of the present invention, the system comprises at least one sheet as in the device of the invention, a sheet holder, and a means for removably attaching at least one sheet to the sheet holder. In one embodiment of the system, the sheet holder is a vial rack, and in another embodiment the sheet holder is a vial carousel. The means for removably attaching a sheet to the sheet holder is a cover in one embodiment of the system of the present invention. In another embodiment, such means comprises an adhesive. In a further embodiment of the system, the means for removably attaching a sheet to the sheet holder comprises at least one registration protrusion extending upward from the sheet holder and at least one registration hole in the sheet for receipt of the at least one registration protrusion.

In an embodiment of the method of the present invention, the method comprises providing a sheet as in the device of the present invention, inserting the first end of a three-dimensional object into the aperture in one of the tags in the sheet, moving the object through the aperture until the aperture reaches a desired contact point on the object, and moving the object in the opposite direction, thereby removing the tag containing the aperture from the carrier portion of the sheet such that the tag remains attached to the contact point of the object. In another embodiment of the method of the present invention, the method comprises providing a sheet as in the device of the present invention, providing a sheet holder as in the system of the present invention, removably attaching the sheet to the sheet holder, inserting the first end of a three-dimensional object into the aperture in one of the tags in the sheet, moving the object through the aperture until the aperture reaches a desired contact point on the object, and moving the object in the opposite direction, thereby removing the tag containing the aperture from the carrier portion of the sheet such that the tag remains attached to the contact point of the object.

The device, system, and method of the present invention satisfy the need for labeling a three-dimensional object quickly and easily. They further satisfy the need for a labeling method that doesn't alter the alignment of the labeled object. The present invention provides a device that enables attachment of identification information to an object such that the attachment is capable of withstanding repeated handling and extreme temperature variations. The need for a manner of adding identification information to an object that is easily read, easily altered, and resistant to smudging and smearing is also met by the present invention. The device, system, and method of the invention permit easy tracking objects at various stages in a process. Additionally, the need for a system that enables easy removal of the identification information is met by the present invention.

These and other features, aspects, and advantages of the present invention will become better understood with reference to the following description and appended claims.

DESCRIPTION

Figure 1:
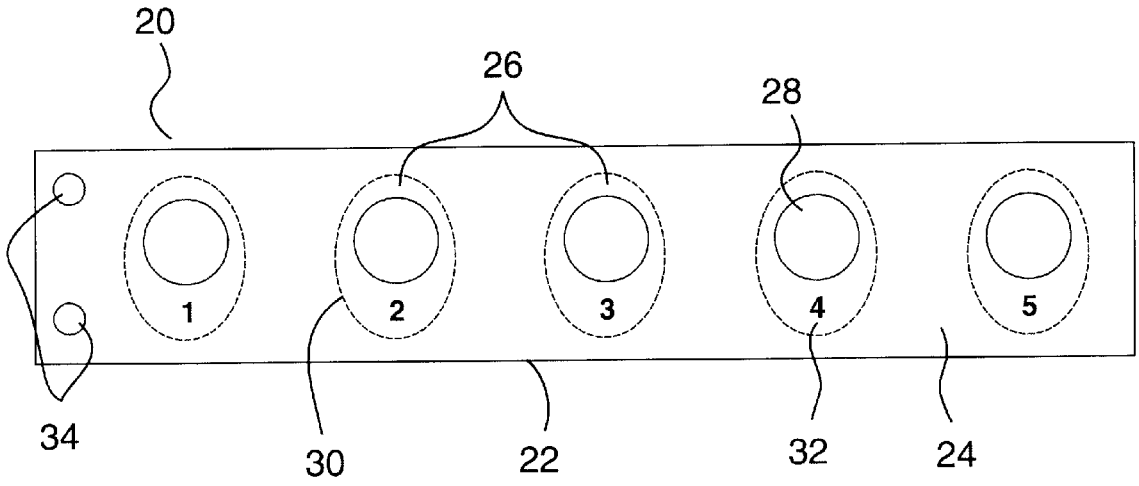
FIG. 1 shows an overhead view of one embodiment of the device of the current invention.

Referring to FIG. 1, there is shown an overhead view of one embodiment of the device for labeling three-dimensional objects according to the present invention. In this embodiment, a device 20 for labeling at least one three-dimensional object comprises a sheet 22 of strong, yet resilient material. The sheet 22 has a carrier portion 24 and at least one tag 26 removably attached to the carrier portion 24. Each of the tags has an aperture 28 therethrough.

In one embodiment, the sheet 22 consists of a thin piece (between about 0.002" and about 0.007" thick) of print-treated polyester, but in other embodiments, the sheet 22 may consist of a thin piece of another flexible material, including, but not limited to, Dupont Tyvek®, polyester film, polyethylene film, polypropylene film, paper, vinyl sheet, rubber, neoprene, or composites of aluminum and polymer. Some salient characteristics of these materials are that they are moisture-resistant and that they are not destroyed or weakened during prolonged storage in high humidity or a wide range of temperatures, from freezing conditions to incubation at high temperatures. Additionally, they are not damaged by solvents that may be spilled during fraction collection. These materials are all available in thin, e.g. 0.002", 0.005", and 0.007", sheets which may be etched using laser energy or chemicals or printed on by offset, silk-screen, dye sublimation, inkjet, or other methods, such as manual inscription with an ink pen or marker.

Individual tags 26 are made in the sheet in a predetermined pattern through a process such as die-cutting or laser-cutting. In one embodiment, the pattern of the tags 26 reproduces the shape of the grid, carousel or belt on a fraction collector. Such patterns may include, but are not limited to, an array of one or more rows and columns or a pattern of one or more concentric circles. The tags 26 may be any of a plurality of shapes and sizes.

The process used to make the tags 26 in the sheet 22 produces a removable attachment 30 of each tag 26 to the carrier portion 24 of the sheet 22. In one embodiment, the removable attachment 30 consists of perforations in the sheet 22 leaving three points of attachment between the tag 26 and the sheet 22. In alternative embodiments, the removable attachment 30 may consist of either more or less perforations in the sheet 22 to result in a different number of breakable attachment points. In another embodiment, the removable attachment 30 consists of areas of weakness in the sheet 22, such as may be created by stamping, etching, or engraving.

Each tag 26 has an aperture 28 therethrough. In the embodiment of FIG. 1, the aperture 28 is circular. In other embodiments, the aperture 28 may be any of a plurality of shapes, including, but not limited to, elliptical, square, triangular, or rectangular. The aperture 28 is dimensioned so as to permit an engagement between the aperture 28 and the three-dimensional object to be labeled, as is explained in further detail herein.

In the embodiment of the invention shown in FIG. 1, an appropriate process is used such that each tag 26 is marked with identification information 32. In this embodiment, identification information 32 comprises numbers. However, other identification information 32, such as, but not limited to, letters, magnetic strip, optical codes, bar codes, graphic images, or other codes are contemplated to be within the scope of the invention. The process used to mark each tag 26 may include, but is not limited to, engraving, etching with a laser or chemicals, printing, stamping, or manual inscription. Each tag 26 may be uniquely identified, or may be identified as part of a particular lot. The present invention also includes within its scope the use of other codes which can be used to identify samples, such as, but not limited to, the color of the sheet 22 or colored tags 26 within the sheet 22. Space can be allowed on the tag 26 for additional identification information 32 which may be later added by the user of the three-dimensional object.

In another embodiment, each tag 26 is not pre-marked with identification information 32, but at least one surface of the tag 26 permits the subsequent addition of identification information 32. Identification information 32 such as, but not limited to, numbers, letters, magnetic strips, optical codes, bar codes, graphic images, or other codes are contemplated to be within the scope of the invention. Also, the tag 26 may be specifically identified by altering the outer shape of the tag 26 or by adding Deoxyribonucleic Acid ("DNA") or fingerprints to the tag 26. The identification information 32 may be added to the tag 26 through the use of a pen, a laser printer, an inkjet printer, an engraver, or other devices. As will be obvious to one of ordinary skill in the art, other means of adding identification information 32 to at least one surface of a tag 26 may be used.

In the embodiment of FIG. 1, registration holes 34 are drilled in or cut from the sheet 22. These holes are positioned and dimensioned so as to closely match the position and size of registration protrusions extending upward from a vial rack or vial mounting block to ensure proper aligrunent of the sheet 22 on the rack or block.

Figure 2:
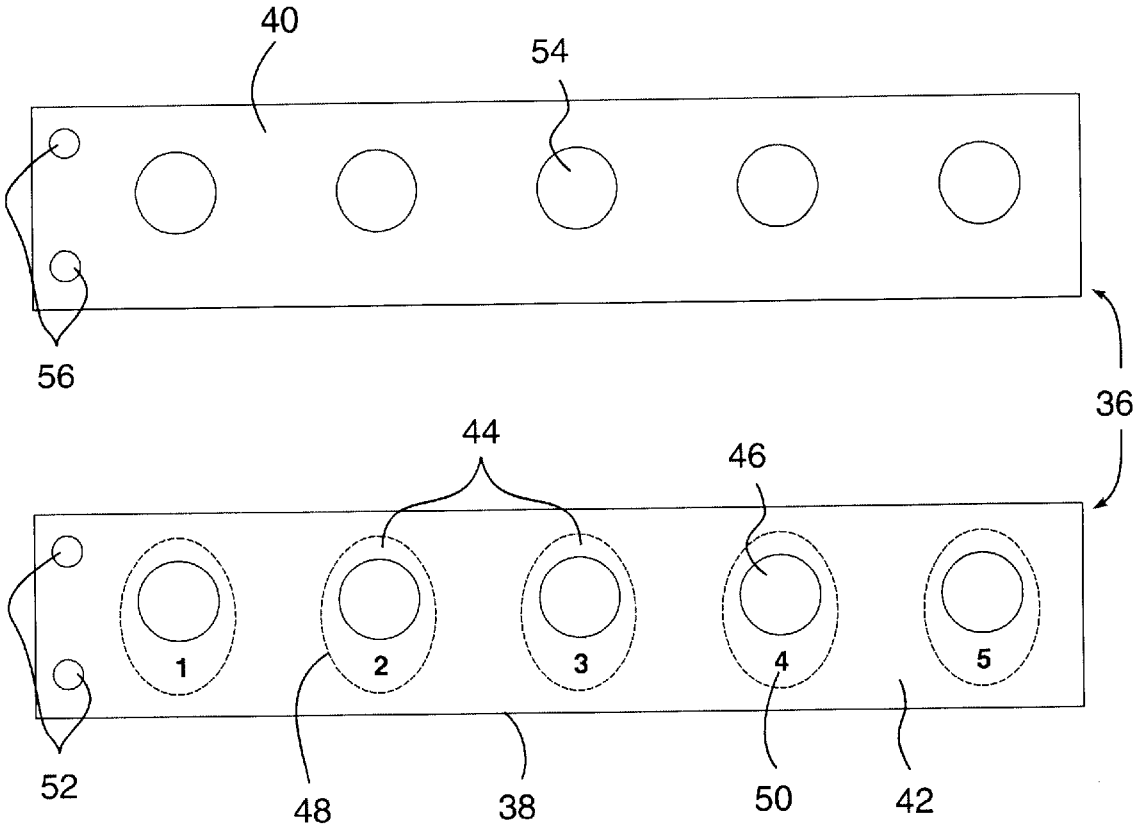
FIG. 2 shows an overhead view of the tag layer and the backing layer of another embodiment of the device of the current invention.

FIG. 2 illustrates an overhead view of an alternative embodiment of the invention. In FIG. 2, the device comprises a sheet 36 comprised of two layers, a tag layer 38 and a backing layer 40. The backing layer 40 would normally be supplied already attached to the tag layer 38, but is illustrated separately in FIG. 2 to show how it is different from the tag layer 38. The tag layer 38 consists of a thin piece (between about 0.002" and about 0.007" thick) of a flexible material, such as those materials comprising the sheet 22 in the embodiment of FIG. 1. The tag layer 38 comprises a carrier portion 42, at least one tag 44 having an aperture 46 therethrough, and a removable attachment 48 of each tag 44 to the carrier portion 42. Alternative embodiments of the tag layer 38 may include any combination of the elements of the one-layer sheet 22 discussed above, including, but not limited to, identification information 50 and registration holes 52.

The backing layer 40 is composed of a material such as paper which eases the handling of the tag layer 38. Weak adhesive, such as is found on a 3M Post-It® note, is used to lightly adhere the tag layer 38 to the backing layer 40. While the present invention includes within its scope the application of adhesive to the tag layer 38, it is preferable to apply the adhesive to the backing layer 40 in order to minimize the mass of the tag 44 when it is attached to the three-dimensional object to be labeled. The backing layer 40 contains holes 54 that are positioned so as to align with the apertures 46 in the tag layer 38. In one embodiment, the holes 54 are approximately the same size as the apertures 46 in the tag layer 38. The backing layer 40 does not contain tags 44. In another embodiment, the backing layer 40 has registration holes 56 positioned and dimensioned so as to match the registration holes 52 in the tag layer 38.

Figure 3A:
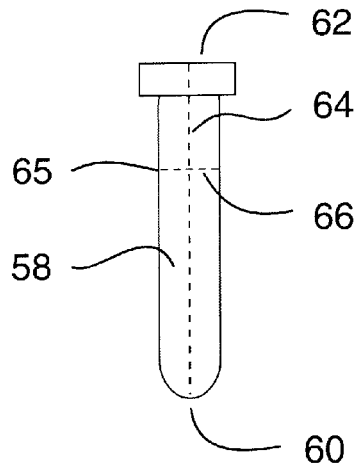
FIGS. 3A, 3B, 3C, 3D, 3E, 3F, 3G, and 3H show side views of three-dimensional objects capable of being labeled by the device, method, and system of the current invention.

The three-dimensional objects that may be labeled by the device, system, and method of the current invention have common characteristics that may be described by reference to FIGS. 3A, 3B, 3C, 3D, 3E, 3F, 3G, and 3H. FIG. 3A shows a side view of a three-dimensional object, a vial. The three-dimensional object 58 in FIG. 3A, has a first end 60 and a second end 62 defining a longitudinal axis 64 therebetween. Between the first end 60 and the second end 62, the three-dimensional object 58 has a desired contact point 65 where the aperture of a tag will be engaged with the outer surface of the three-dimensional object 58. At the desired contact point 65, the object 58 has a desired planar cross-section 66 that defines a contact point surface. The device, system, and method of the present invention are operable to label any such three-dimensional object 58 in which, at no point between the first end 60 and the desired contact point 65, the area of the planar cross-section of the object 58 with the least cross-sectional area is substantially greater than the area of the contact point surface. If an object did not meet this criterion, either the aperture in the tag would be too greatly enlarged by the substantially greater cross-sectional area to engage the object 58 at the desired contact point 65 or the aperture would be unable to travel over the point with the substantially greater cross-sectional area without tearing the tag.

Figure 3B:
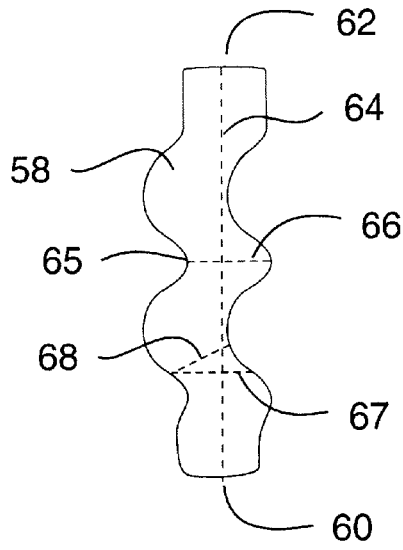

The three-dimensional object 58 in FIG. 3A has a circular cross-sectional area, but the device, system, and method of the present invention are capable of labeling three-dimensional objects having cross-sectional areas of other shapes, including, but not limited to, triangles, squares, ovals, and rectangles. Additionally, the outer surfaces of the three-dimensional object 58 in FIG. 3A are parallel to the longitudinal axis 64, such that at each point between the first end 60 and the second 62, the cross-section with the least cross-sectional area is the cross-section perpendicular to the longitudinal axis 64. The present invention is capable of labeling objects that are dimensioned such that the outer surfaces of the object are not always parallel to the object's longitudinal axis. FIG. 3B shows a side view of an object 58 with curved outer surfaces such that they are not always parallel to the object's longitudinal axis 64. Therefore, at a point between the first end 60 of the object 58 and the desired contact point 65 of the object, the area of a cross-section 67 perpendicular to the longitudinal axis 64 is greater than the area of the desired cross-section 66 at the desired contact point 65. However, the device, system, and method are capable of labeling the object 58 of FIG. 3B because at that point between the first end 60 and the desired contact point 65, the area of the cross-section 68 with the least cross-sectional area is not substantially greater than the cross-section of the contact point surface defined by the desired cross-section 67. Therefore, the aperture in a tag would be able to pass over that point without excessively enlarging the aperture and without tearing the tag.

Figure 3C:
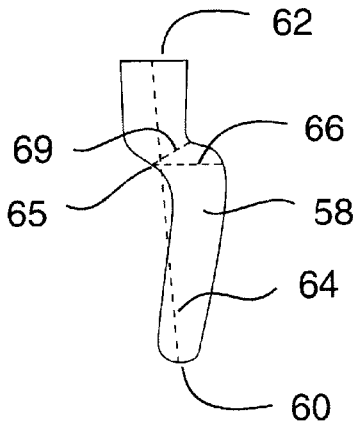

FIG. 3C shows a side view of an object 58 with outer surfaces that are not parallel to the object's longitudinal axis 64. FIG. 3C illustrates that the desired cross-section 66 at the desired contact point 65 need not be the cross-section intersecting the desired contact point 65 with the least cross-sectional area. Because at at least one point between the first end 60 of the object 58 and the desired contact point 65 the area of the cross-section with the least cross-sectional area is substantially greater than the area of the cross-section 69, if cross-section 69 was designated as a desired cross-section, the device, system, and method of the present invention would likely be unable to label the object 58. However, because at each point between the first end 60 and the actual desired contact point 65 of the object 58 the area of the planar cross-section of the object 58 with the least cross-sectional area is not substantially greater than the area of the contact point surface of the object 58, defined by the desired cross-section 66, the object may be labeled by the present invention.

Figure 3D:
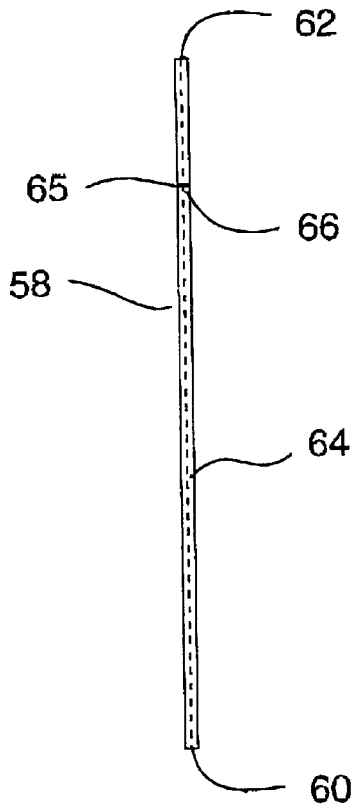
Figure 3E:
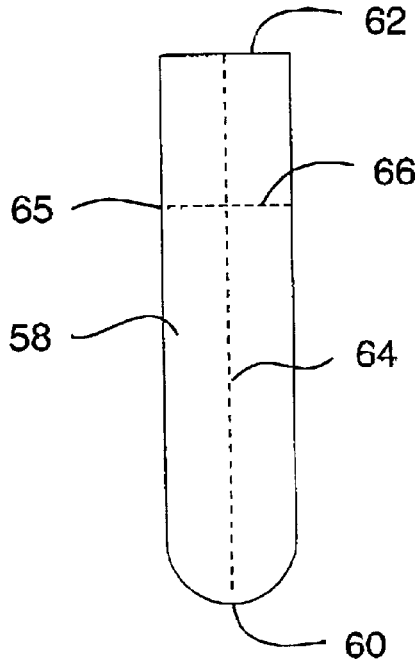
Figure 3F:
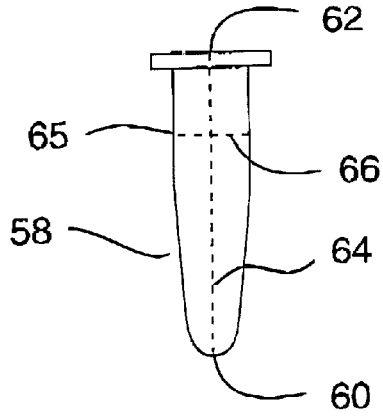
Figure 3G:
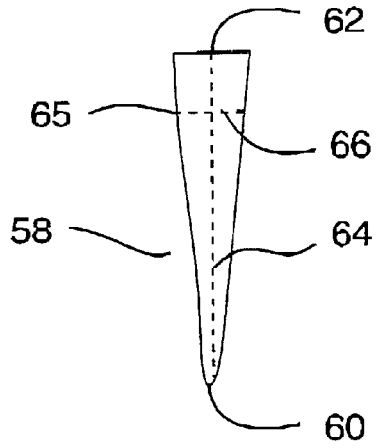
Figure 3H:
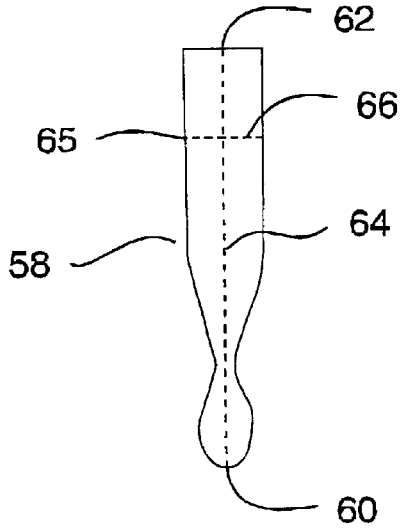

FIGS. 3D, 3E, 3F, 3G, and 3H show side views of other three-dimensional objects that may be labeled by the present invention. Each of the objects 58 has a first end 60, a second end 62, a longitudinal axis 64, a desired contact point 65, and a desired planar cross-section 66. FIG. 3D shows a side view of a capillary tube. Capillary tubes are typically made of glass, plastic, or stainless steel and are typically open on both ends. FIG. 3E shows a side view of a centrifuge or reaction tube. FIG. 3F shows a side view of a microcentrifuge tube, and FIG. 3G shows a side view of a tapered tube. FIG. 3H shows a side view of a tube for lyophilized materials. Such tubes are usually sealed on both ends. As will be obvious to one skilled in the art, the three-dimensional objects shown in FIGS. 3A, 3B, 3C, 3D, 3E, 3F, 3G, and 3H are merely representative of the many types of objects that may be labeled by the present invention.

Figure 4A:
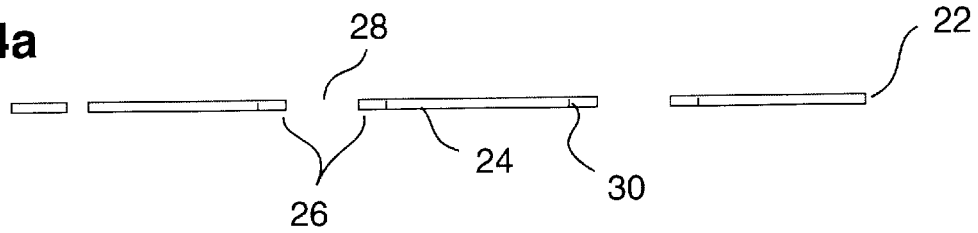
FIGS. 4A, 4B, and 4C show side views of the embodiment of the device of FIG. 1 and vials to illustrate the sequence of inserting vials into the device.
Figure 4B:
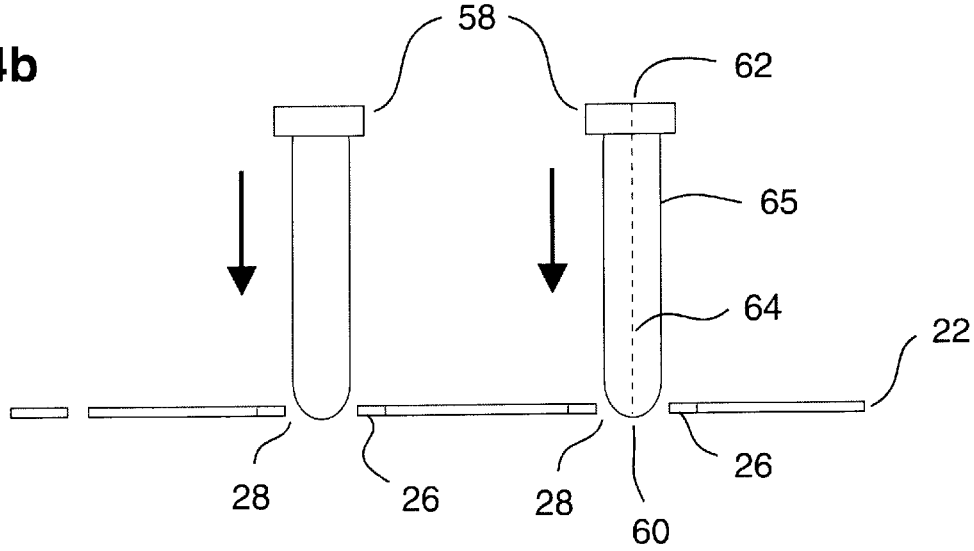
Figure 4C:
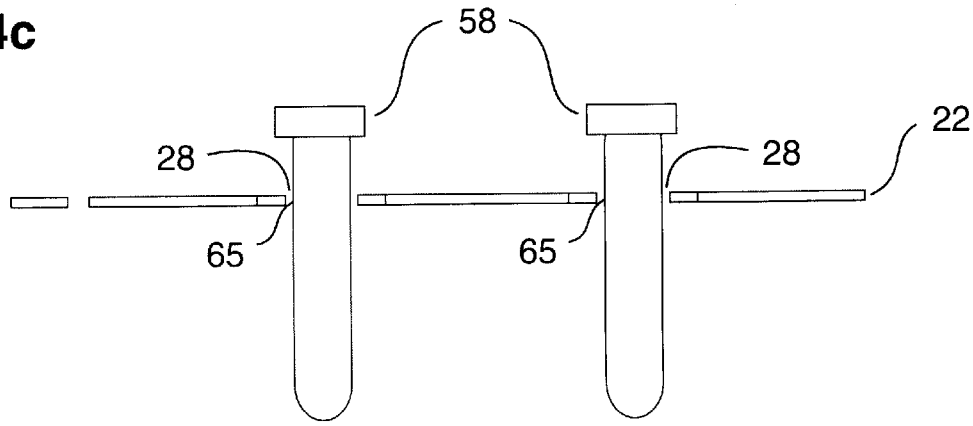
Figure 5:
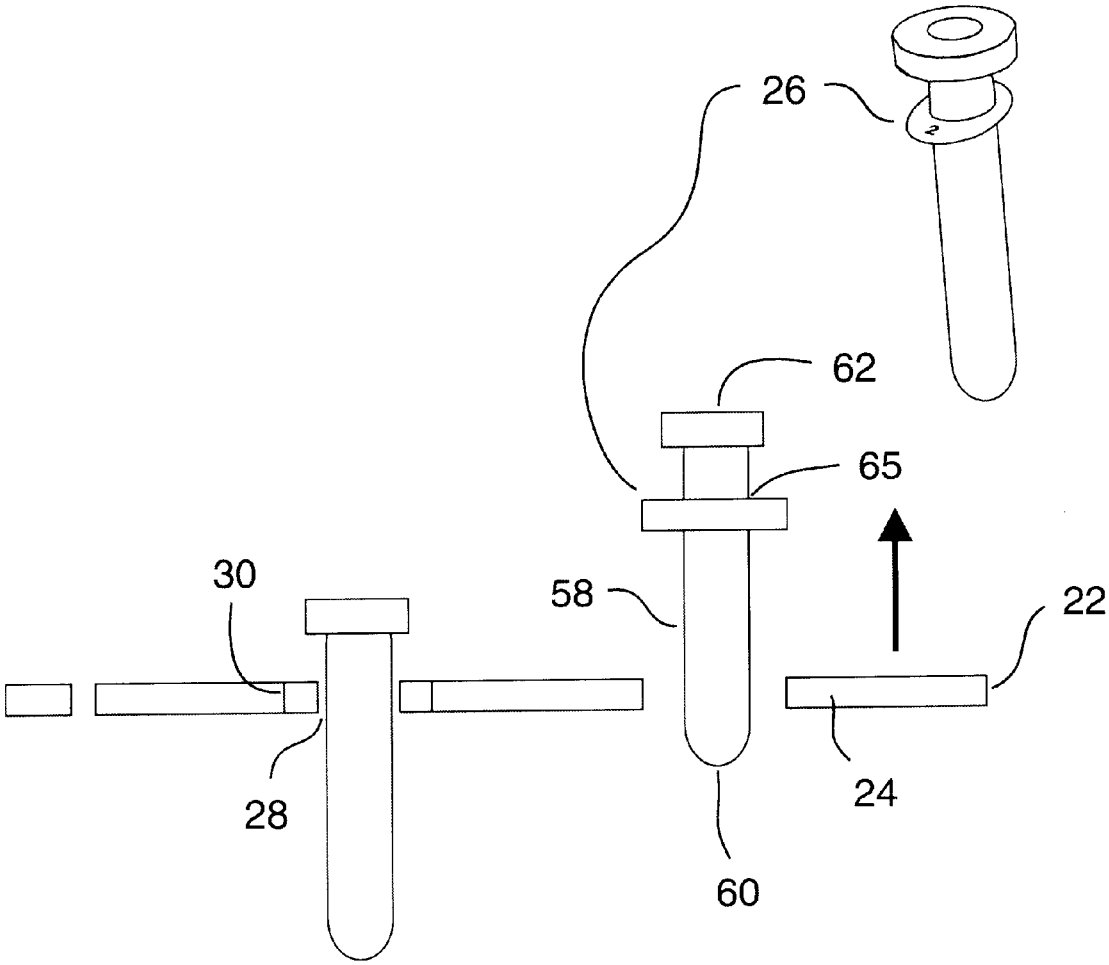
FIG. 5 shows a side view of the embodiment of the device of FIGS. 4A, 4B, and 4C illustrating the step of removing a vial from the device of FIG. 1 and a labeled vial.

A method for labeling a three-dimensional object with the device of the present invention can be described by reference to FIGS. 4A, 4B, 4C, and 5. FIGS. 4A, 4B, and 4C show side views of the embodiment of the device of FIG. 1 and vials to illustrate the sequence of inserting vials into the device. FIG. 5 shows a side view of the embodiment of the device of FIGS. 4A, 4B, and 4C illustrating the step of removing a vial from the device of FIG. 1 and a labeled vial.

In FIG. 4A, a side view of the embodiment of the device of FIG. 1 is shown. In FIG. 4B, the three-dimensional object 58 to be labeled is a vial. Either the first end 60 of the object 58 is inserted into an aperture 28 in one of the tags 26 in the sheet 22 or the aperture 28 in one of the tags 26 in the sheet 22 is placed over the first end of the object 58. Referring to FIG. 4C, the object 58 is then moved through the aperture 28 toward the first end 60 of the object 58. Alternatively, the sheet 22 is moved toward the contact point 65 of the object 58. As the aperture 28 reaches the contact point 65 of the object 58, an engagement is created between the aperture 28 and the outer surface of the object 58. This engagement may be the result of one or more of a plurality of forces, including, but not limited to, (i) a frictional force between the aperture 28 and the outer surface of the object 58 and (ii) an adhesive force resulting from the presence of an adhesive on at least one point of least one edge of the aperture 28 or the presence of an adhesive on at least one point on the outer surface of the object 58.

In FIG. 5, the object 58 is moved away from the sheet 22 toward the second end 62 of the object 58 or the sheet 22 is moved toward the first end 60 of the object 58, thereby removing the tag 26 from the carrier portion 24 of the sheet 22 and leaving the tag 26 engaged with the object 58 at the contact point 65. This separation of the tag 26 from the carrier portion 24 of the sheet 22 occurs because the strength of the engagement between the aperture 28 and the outer surface of the object 58 is greater than the strength of the removable attachment 30 of the tag 26 to the carrier portion 24 of the sheet 22. A perspective view of a tagged vial may also by seen in FIG. 5.

An alternative method of labeling the three-dimensional object 58 includes the steps illustrated in FIGS. 4A, 4B, and 4C and described above. After the aperture 28 reaches the contact point 65 of the object 58 in FIG. 4C, the movement of the second end 62 of the object 58 toward the sheet 22, or the movement of the sheet 22 toward the second end 62 of the object 58, is continued, thereby removing the tag 26 from the carrier portion 24 of the sheet 22 and leaving the tag 26 engaged with the object 58 at the contact point 65. This separation of the tag 26 from the carrier portion 24 of the sheet 22 occurs because the strength of the removable attachment 30 of the tag 26 to the carrier portion 24 of the sheet 22 is overcome by either (i) the strength of the engagement between the aperture 28 and the outer surface of the object 58 or (ii) a force placed upon the tag 36 in the direction of the movement of the object 58. Such a force may be exerted by a cross-section of the object 58 that has a substantially greater area than the contact point surface and that is adjacent to the contact point 65 on the side of the contact point 65 closest to the second end 62 of the object 58, e.g., the cross-section of the lip of a vial. Alternatively, the force may be exerted on the tag 26 by an entity separate from the object 58.

Figure 6A:
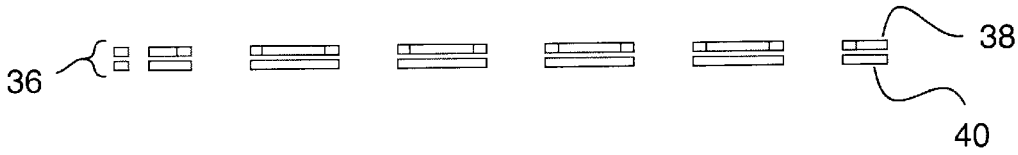
FIGS. 6A, 6B, and 6C show side views of the embodiment of the device of FIG. 2 and vials to illustrate the sequence of inserting vials into the device.
Figure 6B:
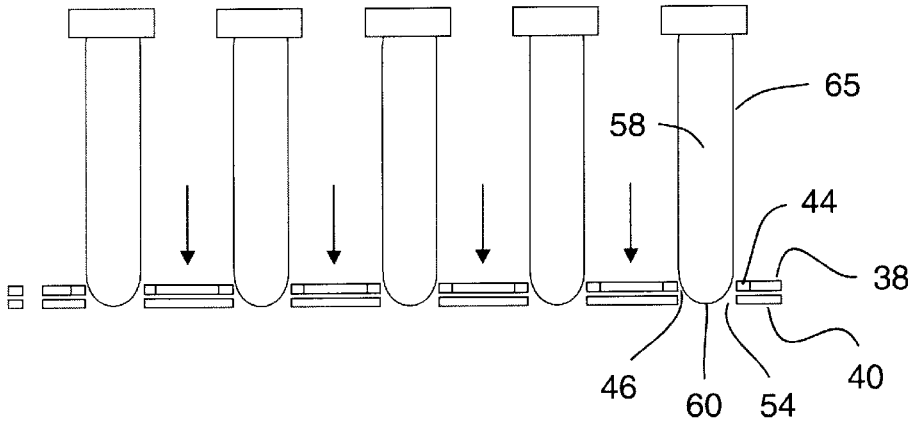
Figure 6C:
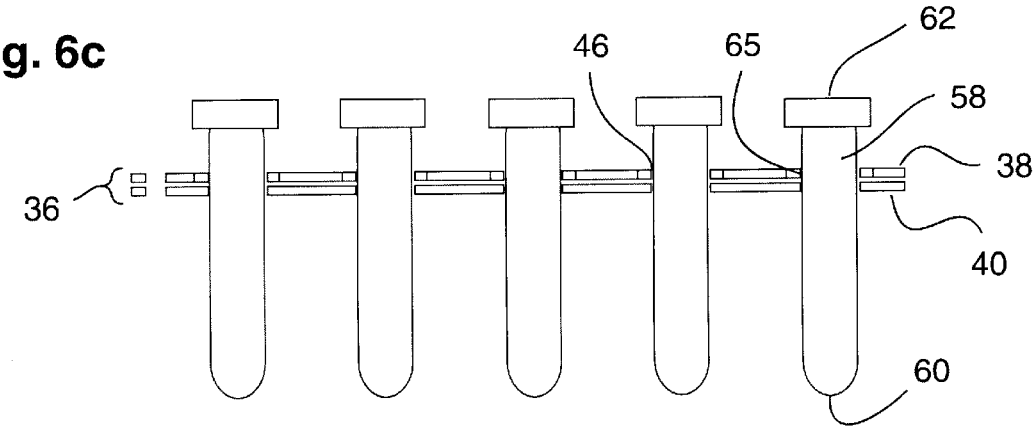
Figure 7:
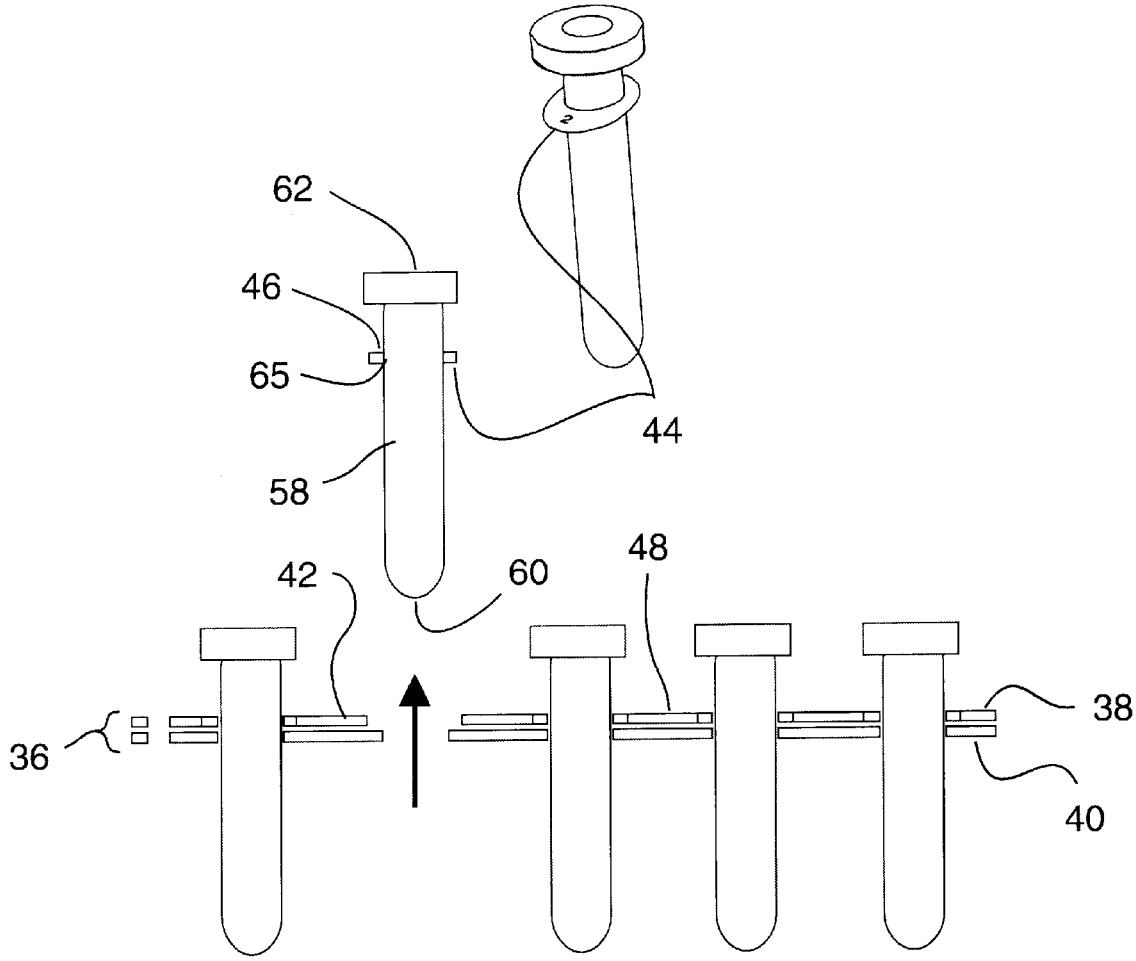
FIG. 7 shows a side view of the embodiment of FIGS. 6A, 6B, and 6C illustrating the step of removing a vial from the device of FIG. 2 and a labeled vial.

FIGS. 6A, 6B, 6C, and 7 illustrate a method for labeling a three-dimensional object 58 using the alternative embodiment of the current invention consisting of a sheet 36 with a tag layer 38 and a backing layer 40. FIGS. 6A, 6B, and 6C show side views of the embodiment of the device of FIG. 2 and vials to illustrate the sequence of inserting vials into the device. FIG. 7 shows a side view of the embodiment of FIGS. 6A, 6B, and 6C illustrating the step of removing a vial from the device of FIG. 2 and a labeled vial.

In FIG. 6A, a side view of the embodiment of the device of FIG. 2 is shown. Referring to FIG. 6B, either the first end 60 of the object 58 is inserted into an aperture 46 in one of the tags 44 in the tag layer 38 or the aperture 46 in one of the tags 44 in the tag layer 38 is placed over the first end 60 of the object 58. In FIG. 6C, the object 58 is then moved through the aperture 46 and the hole 54 in the backing layer 40 toward the first end 60 of the object 58. Alternatively, the sheet 36 is moved toward the contact point 65 of the object 58. As the aperture 46 reaches the contact point 65 of the object 58, an engagement is created between the aperture 46 and the outer surface of the object 58.

In FIG. 7, the object 58 is moved away from the sheet 36 toward the second end 62 of the object 58 or the sheet 36 is moved toward the first end 60 of the object 58, thereby removing the tag 44 from the carrier portion 42 of the tag layer 38 and from the backing layer 40 and leaving the tag 44 engaged with the object 58 at the contact point 65. This separation of the tag 44 from the carrier portion 42 of the tag layer 38 and from the backing layer 40 occurs because the strength of the engagement between the aperture 46 and the outer surface of the object 58 is greater than the strength of the combination of the removable attachment 48 of the tag 44 to the carrier portion 42 of the tag layer 38 and the adhesive attachment of the tag layer 38 to the backing layer 40. A perspective view of a tagged vial may also by seen in FIG. 7.

Figure 8:
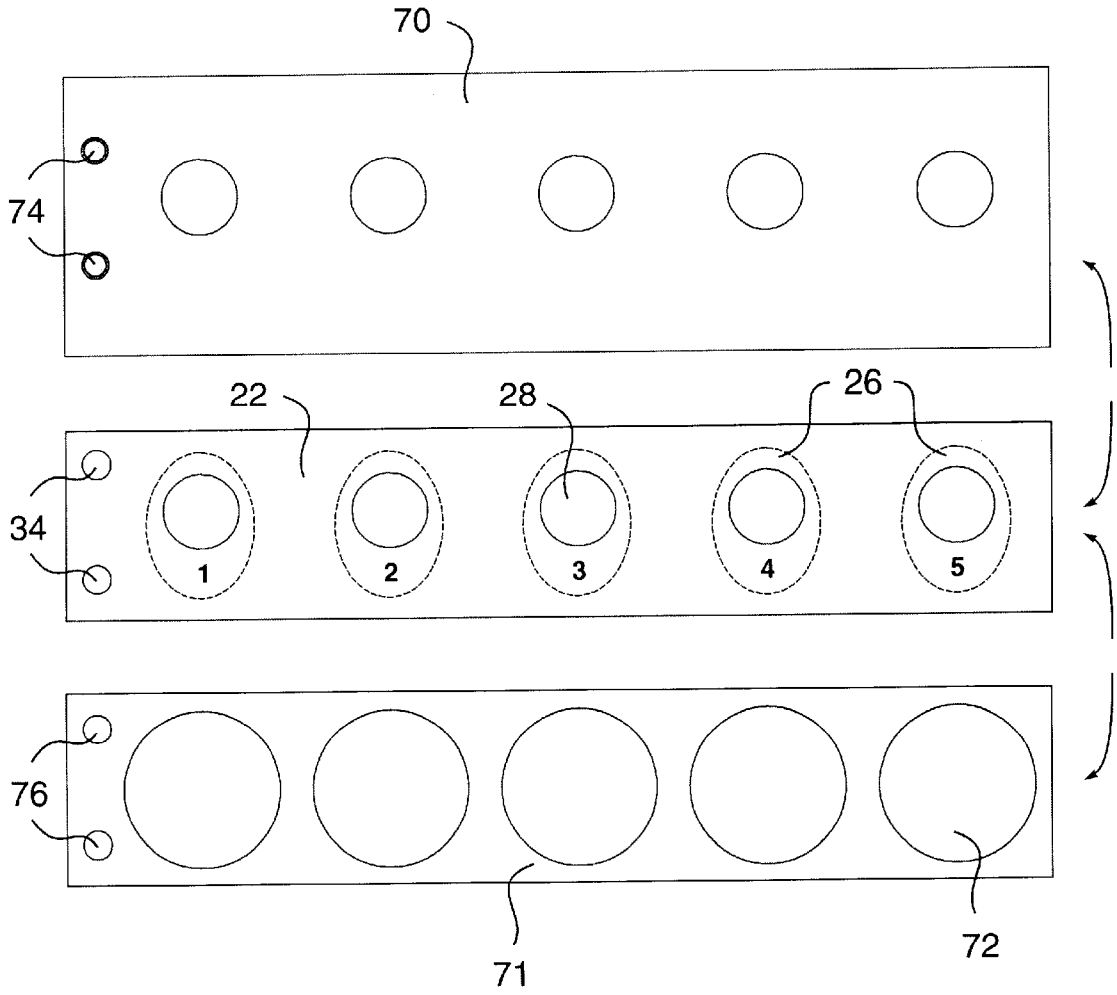
FIG. 8 shows an overhead view of one embodiment of the system of the present invention.

FIG. 8 is an overhead view of one embodiment of the system of the present invention for labeling a three-dimensional object. The system comprises a sheet 22 as previously described, a sheet holder 70, and a means for removably attaching the sheet 22 to the sheet holder 70. In the embodiment illustrated in FIG. 8, the sheet holder 70 is a rack that also holds vials. In another embodiment, the sheet holder 70 is a carousel or belt that holds vials. In the embodiment illustrated in FIG. 8, the means for removably attaching the sheet 22 to the sheet holder 70 is a cover 71. The cover has holes 72 therethrough positioned and dimensioned such that when the cover 71 is placed over the sheet 22 each tag 26 in the sheet 22 is completely visible through a hole 72 in the cover 71. In an alternative embodiment of the current invention the means for removably attaching the sheet 22 to the sheet holder 70 may comprise at least one registration protrusion 74 extending upward from the sheet holder 70 and at least one registration hole 34 in the sheet 22 for receipt of at least one registration protrusion 74. The cover 71 may also have registration holes 76 therethrough. In other embodiments, the means for removably attaching the sheet 22 to the sheet holder 70 may comprise an adhesive or a force applied by the user of the system. It will be appreciated by those of ordinary skill in the art that other means for removably attaching the sheet 22 to the sheet holder 70 and other means for aligning the sheet 22 with the sheet holder 70 exist, including, but not limited to, screws, clips, clamps, rubber bands, or tape.

Figure 9A:
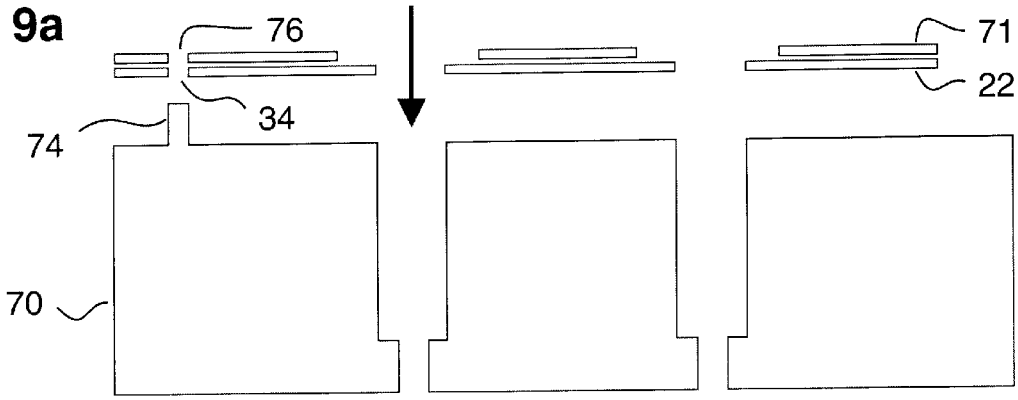
FIGS. 9A, 9B, and 9C show side views of the system of FIG. 8 and vials to illustrate the sequence of attaching a sheet and cover to a sheet holder and inserting vials into the system.
Figure 9B:
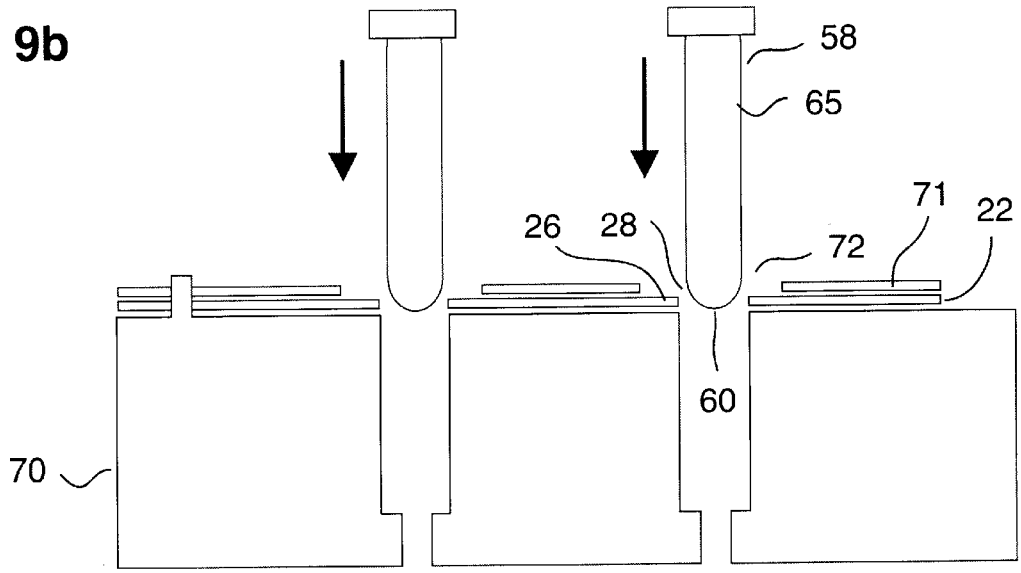
Figure 9C:
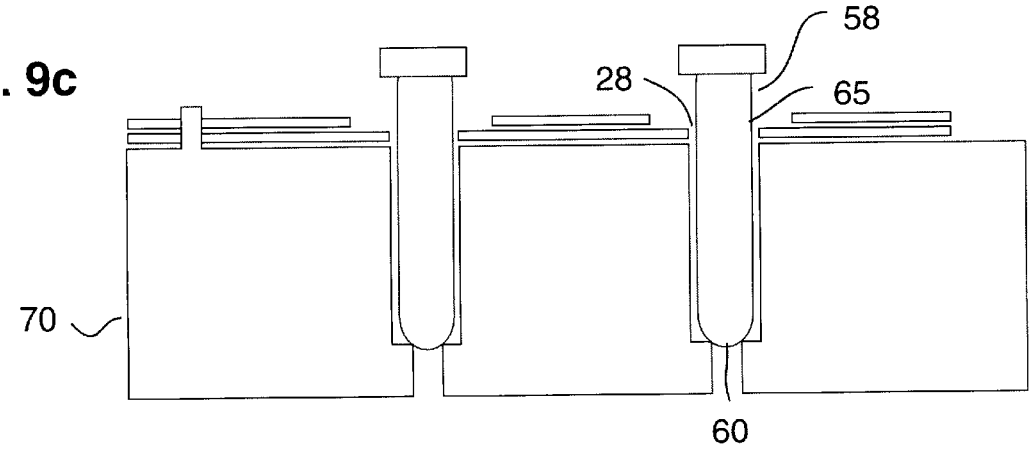
Figure 10:
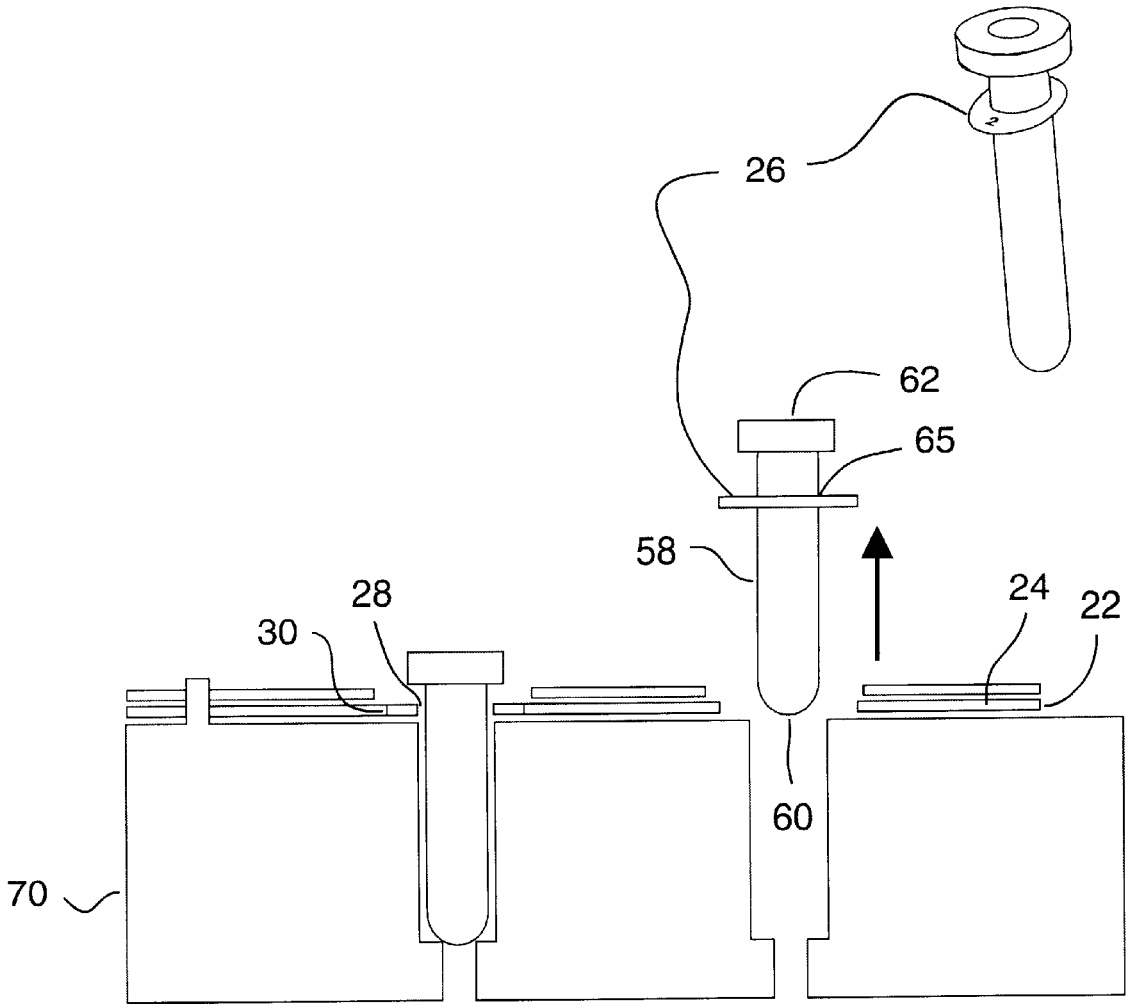
FIG. 10 shows a side view of the embodiment of FIGS. 9A, 9B, and 9C illustrating the sequence of removing a vial from the system of FIG. 8 and a labeled vial.

Referring to FIGS. 9A, 9B, 9C, and 10, a method for labeling a three-dimensional object with an embodiment of the system of the present invention can be described. FIGS. 9A, 9B, and 9C show side views of the system of FIG. 8 and vials to illustrate the sequence of attaching a sheet and cover to a sheet holder and inserting vials into the system. FIG. 10 shows a side view of the embodiment of FIGS. 9A, 9B, and 9C illustrating the sequence of removing a vial from the system of FIG. 8 and a labeled vial.

In FIG. 9A, at least one sheet 22 is removably attached to the sheet holder 70. This removable attachment is achieved by placing the cover 71 over the sheet 22 such that registration holes 76 in the cover 71 are aligned with the registration holes 34 in the sheet 22 and by placing the cover 71 and the sheet 22 on the sheet holder 70 by positioning the cover 71 and the sheet 22 such that the registration protrusions 74 extending upward from the sheet holder 70 protrude through the registration holes 34 and 76 of the sheet 22 and the cover 71, respectively.

Referring to FIG. 9B, the first end 71 of the object 58 to be labeled is inserted through a hole 72 in the cover 71 and into an aperture 28 in one of the tags 26 in the sheet 22. Alternatively, a hole 72 in the cover 71 and the aperture 28 in one of the tags 26 in the sheet 22 are placed over the first end 60 of the object 58. In FIG. 9C, the object 58 is then moved through the aperture 28 toward the first end 60 of the object 58. Alternatively, the sheet holder 70 is moved toward the contact point 65 of the object 58. As the aperture 28 reaches the contact point 65 of the object 58, an engagement is created between the aperture 28 and the outer surface of the object 58. In the embodiment of the invention illustrated in FIG. 9, at this point in the method the first end 60 of the object 58 contacts the sheet holder 70, and the sheet holder 70 holds the object 58. The object 58 may then be filled with contents without being held by the user of the object 58.

Referring now to FIG. 10, the object 58 is moved away from the sheet holder 70 toward the second end 62 of the object 58 or the top of the sheet holder 70 is moved toward the first end 60 of the object 58, thereby removing the tag 26 from the carrier portion 24 of the sheet 22 and leaving the tag 26 engaged with the object 58 at the contact point 65. This separation of the tag 26 from the carrier portion 24 of the sheet 22 occurs because the strength of the engagement between the aperture 28 and the outer surface of the object 58 is greater than the strength of the removable attachment 30 of the tag 26 to the carrier portion 24 of the sheet 22. A perspective view of a tagged vial may also by seen in FIG. 10.

Figure 11:
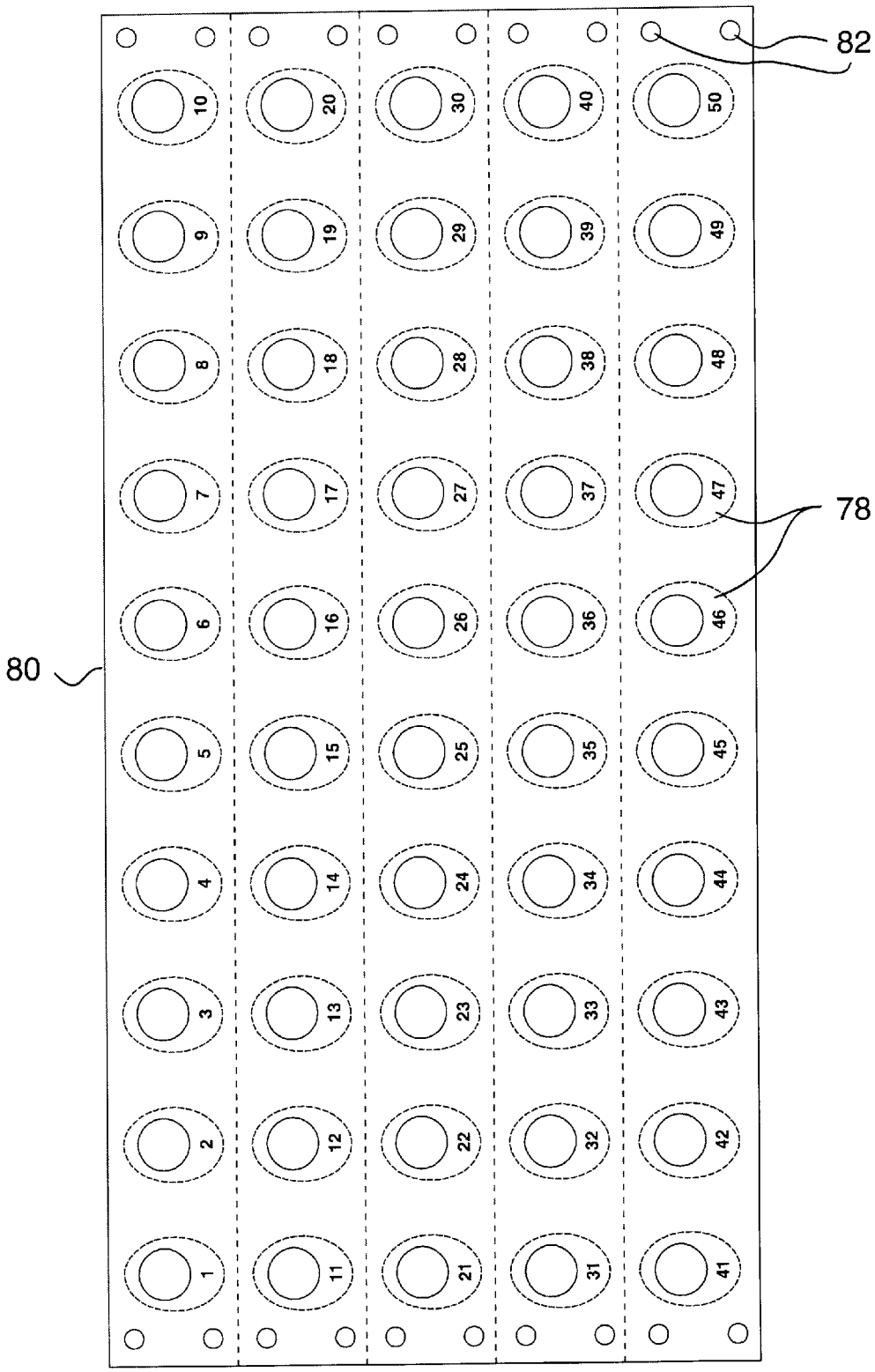
FIG. 11 shows an overhead view of an embodiment of the device of the current invention.

FIG. 11 shows an overhead view of an embodiment of the device of the current invention. In FIG. 11, tags 78 are organized on a sheet 80 that is perforated into strips. Each strip has a set of registration holes 82, so that individual strips or the entire sheet 80 can be mounted on a sheet holder having registration protrusions. The organization of the tags 78 can be in a rectangular fashion, as shown, or in a circle, or a triangle, or any other shape which matches the format of the sheet holder being utilized.

Figure 12A:
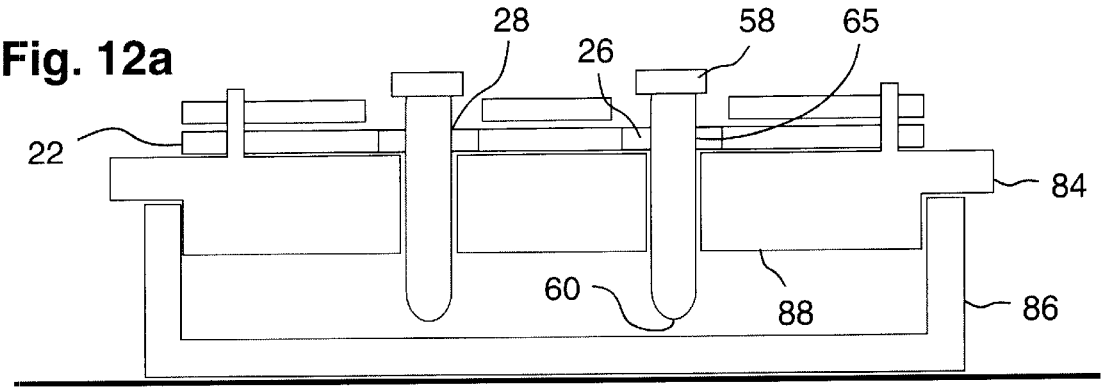
FIGS. 12A, 12B, 12C, and 12D show a side view of another embodiment of the system of the present invention and vials to illustrate a sequence of labeling vials.

FIGS. 12A, 12B, 12C, and 12D show a side view of another embodiment of the system of the present invention and vials to illustrate a sequence of labeling multiple vials at one time. In FIG. 12A, a sheet holder 84 is combined with a sheet holder support 86. The sheet holder 84 is dimensioned so as to permit the first end 60 of an object 58 that is inserted into the sheet holder 84 to protrude below the bottom surface 88 of the sheet holder 84. The sheet holder 84 is placed on top of the sheet holder support 86. The steps illustrated in FIGS. 9B and 9C are then taken using this version of the invention, resulting in an engagement between the aperture 28 in one of the tags 26 in the sheet 22 and an object 58 at the contact point 65 of the object 58.

Figure 12B:
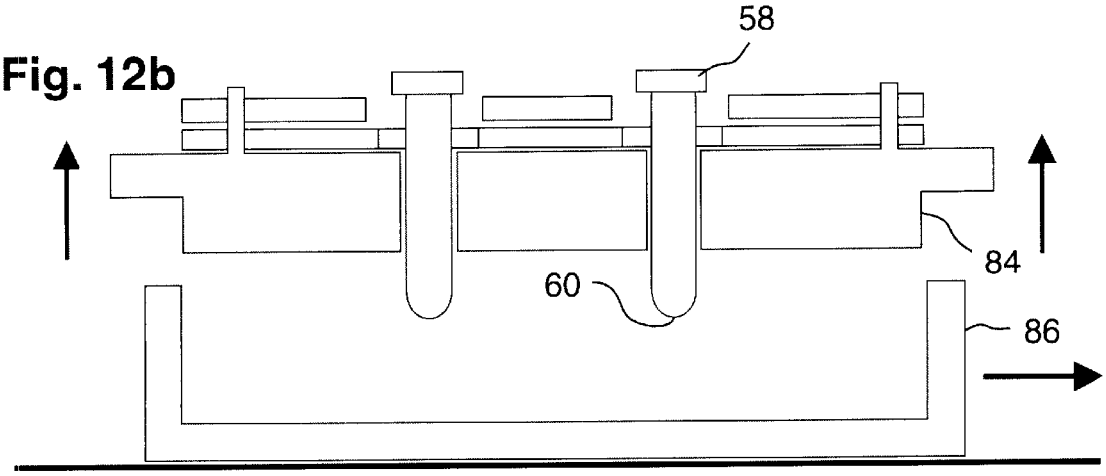
Figure 12C:
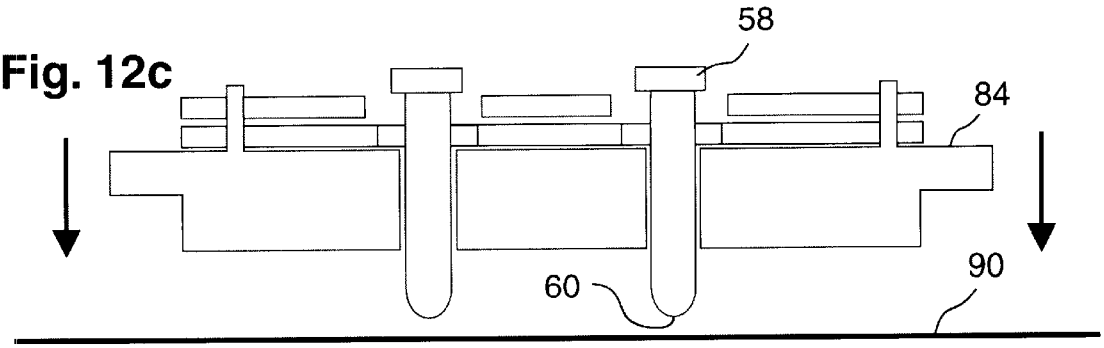
Figure 12D:
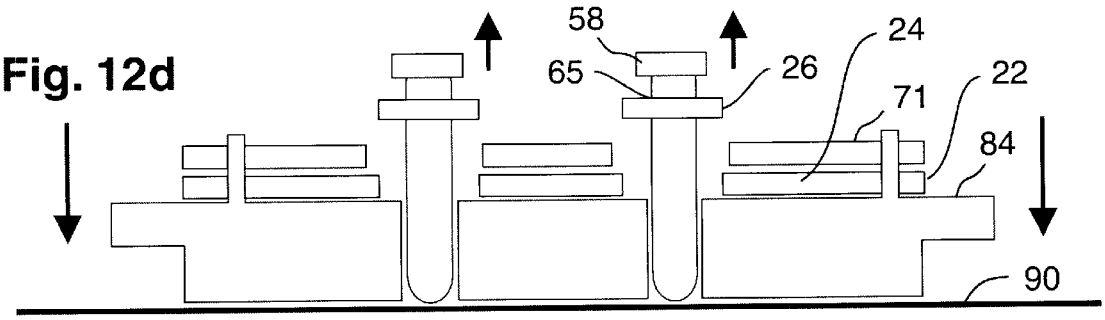

In FIG. 12B, the sheet holder 84 is moved away from the sheet holder support 86 and the sheet holder support 86 is removed. Referring to FIG. 12C, the sheet holder 84 is then moved towards a substantially planar surface 90 until the first end 60 of the object 58 contained in the sheet holder 84 contacts the surface 90. In FIG. 12D, the cover 71, the sheet 22, and the sheet holder 84 are then moved toward the surface 90 with a force sufficient to remove the tag 26 from the carrier portion 24 of the sheet 22, leaving the tag 26 engaged with the object 58 at the contact point 65. This movement of the sheet holder 84 causes, at one time, the transfer of a tag 26 to each object 58 in the sheet holder 84, thereby speeding up the labeling process.

As will be obvious to those skilled in the art, the previously described versions of the present invention have many significant advantages. One advantage of the invention is the provision of a device, system and method whereby an identification tag is automatically attached to an object, such as a sample vial, as it is being inserted into a sheet holder, such as a vial rack. Thus, identification information is added to the vial quickly and easily. The objects may be labeled very quickly if a machine is used to perform the method of the current invention. Another advantage is the provision of a device which does not rely solely on the use of an adhesive to maintain the tag in contact with the vial. Because the tag is not solely maintained on the vial by an adhesive, there is no risk of loss of adhesion during freezing and thawing cycles.

Yet another advantage of the invention is the provision of a device which does not require the use of a marking pen, inkjet, or other marking device to add an ink-based code to the vial itself. A further advantage is the provision of a device for the identification of individual glass or plastic vials by means of preprinted or etched codes, numbers, letters, symbols or bar codes. Because the tags can be offset printed with indelible inks, etched, or stamped, the identification information remains readable when exposed to solvents including water and alcohols. In the case of magnetic or optical encoding, positive sample identification through automated readers is possible. Also, the invention has the advantage of including the means for the user to differentiate separate lots of samples or samples in different stages of a process by using different colors of ink codes or tags or different shapes of tags. The invention also permits users to enter additional information on the tag as needed for identification of a group of samples.

Yet another advantage of the invention is the provision of a device which binds the tag tightly so that the tag does not fall off during transfer of the vial to other devices. Also, because the tags are sufficiently strong and resistant to tearing, a tag is likely to remain with a vial throughout several transfers. Because the tags of the invention are made of thin, flexible material, they can be bent and folded so as not to interfere with the positioning of a vial as it is transferred to and placed in other devices, carriers, or chemical analyzers. Because the tags are light and the weight of the tags are relatively evenly distributed around the vial, the tags do not alter the alignment of the vials. Additionally, this invention is resistant to damage by moisture caused by high humidity, freezing, refrigeration, high temperatures, or spillage of water and other solvents during use.

The invention further allows automatic identification and storage of the vials loaded into it so that they do not fall out due to tipping or inversion of the device, yet also allows deliberate removal of the vials as needed. That the invention can be easily removed from a vial when experimentation is complete without leaving any residue on the vial or physically altering the vial is also an advantage over the prior art.

Although the present invention has been described in considerable detail with reference to certain preferred versions thereof, other versions are possible. For example, the user of a three-dimensional object to be labeled could manually remove a tag from the carrier portion of the tag's sheet and then place the tag onto the three-dimensional object by hand. This version of the method of the present invention is contemplated to be within the scope of the invention. Therefore, the spirit and scope of the appended claims should not be limited to the description of the preferred versions contained herein.

What is claimed is:

1. A device for labeling at least one three-dimensional object, each object having a first end and a second end defining a longitudinal axis therebetween, each object further having between the first end and the second end a desired contact point and a desired planar cross-section intersecting the desired contact point of the object defining a contact point surface of the object, each object so dimensioned that at each point between the first end and the desired contact point of the object the area of the planar cross-section of the object with the least cross-sectional area is not substantially greater than the area of the contact point surface of the object, the device comprising:

a sheet having a carrier portion; and at least one tag removably attached to the carrier portion, each of the tags having an aperture therethrough, the aperture dimensioned so that an engagement forms between the aperture and one of the objects at the contact point of the object which is of sufficient strength to overcome the strength of the tag's removable attachment to the carrier portion of the sheet when one of the at least one objects is inserted through the aperture from the first end to the contact point of the at least one object or when the aperture is slipped over the first end to the contact point of the at least one object.

2. The device of claim 1, wherein the sheet is comprised of a resilient material.

3. The device of claim 2, wherein the resilient material is print-treated polyester.

4. The device of claim 1, wherein the sheet is comprised of paper.

5. The device of claim 1, wherein the sheet comprises at least one of a plurality of colors.

6. The device of claim 1, wherein the removable attachment for each of the at least one tags comprises perforations in the sheet.

7. The device of claim 6, wherein the perforations are created by die-cutting.

8. The device of claim 6, wherein the perforations are created by a laser.

9. The device of claim 1, wherein at least one surface of at least one of the tags permits the addition of identification information.

10. The device of claim 1, wherein at least one surface of at least one of the tags contains identification information.

11. The device of claim 10, wherein the identification information comprises a barcode.

12. The device of claim 10, wherein the identification information is printed on the at least one surface.

13. The device of claim 10, wherein the identification information is engraved on the at least one surface.

14. The device of claim 10, wherein the identification information is laser etched on the at least one surface.

15. The device of claim 10, wherein the identification information is stamped into the at least one surface.

16. The device of claim 1, wherein the sheet further includes registration holes for placement on a holder having registration protrusions thereon.

17. The device of claim 1, wherein the tags are positioned in an array of one or more rows and columns.

18. The device of claim 1, wherein the tags are positioned in at least one circle.

19. The device of claim 1, wherein the sheet is comprised of a tag layer and a backing layer.

20. The device of claim 19, wherein the tag layer is adhered to the backing layer with an adhesive.

21. The device of claim 1, wherein the engagement is the result of at least one frictional force between the aperture and the object.

22. The device of claim 21, wherein the strength of the engagement is increased by at least one adhesive force.

23. The device of claim 1, wherein at least one point on at least one edge of the aperture contains an adhesive.

24. A device for labeling at least one three-dimensional object, each object having a first end and a second end defining a longitudinal axis therebetween, each object further having between the first end and the second end a desired contact point and a desired planar cross-section intersecting the desired contact point of the object defining a contact point surface of the object, each object so dimensioned that at each point between the first end and the desired contact point of the object the area of the planar cross-section of the object with the least cross-sectional area is not substantially greater than the area of the contact point surface of the object, the device comprising:

a sheet having at least one tag, the outer dimension of each of the at least one tags defined by areas of weakness in the sheet, each of the at least one tags having an aperture therethrough, the aperture dimensioned so that an engagement forms between the aperture and one of the at least one objects at the contact point of the object, such that when one of the objects is inserted into the aperture from the first end of the object to the contact point of the object or such that when the aperture is slipped over the first end of the at least one object to the contact point of the object, the engagement causes separation of the tag from the sheet at the areas of weakness defining the outer dimension of the tag.

25. A system for labeling at least one three-dimensional object, each object having a first end and a second end defining a longitudinal axis therebetween, each object further having between the first end and the second end a desired contact point and a desired planar cross-section intersecting the desired contact point of the object defining a contact point surface of the object, each object so dimensioned that at each point between the first end and the desired contact point of the object the area of the planar cross-section of the object with the least cross-sectional area is not substantially greater than the area of the contact point surface of the object, the system comprising:

at least one sheet, the sheet having a carrier portion and at least one tag removably attached to the carrier portion, each of the tags having an aperture therethrough, the aperture dimensioned so that an engagement forms between the aperture and one of the objects at the contact point of the object which is of sufficient strength to overcome the strength of the tag's removable attachment to the carrier portion of the sheet when one of the at least one objects is inserted through the aperture from the first end to the contact point of the at least one object or when the aperture is slipped over the first end to the contact point of the at least one object;

a sheet holder; and a means for removably attaching at least one of the at least one sheets to the sheet holder.

26. The system of claim 25, wherein the three-dimensional object is a vial.

27. A system for labeling at least one three-dimensional object, each object having a first end and a second end defining a longitudinal axis therebetween, each object further having between the first end and the second end a desired contact point and a desired planar cross-section intersecting the desired contact point of the object defining a contact point surface of the object, each object so dimensioned that at each point between the first end and the desired contact point of the object the area of the planar cross-section of the object with the least cross-sectional area is not substantially greater than the area of the contact point surface of the object, the system comprising:

at least one sheet, the sheet having a carrier portion and at least one tag removably attached to the carrier portion, each of the tags having an aperture therethrough, the aperture dimensioned so that an engagement forms between the aperture and one of the objects at the contact point of the object which is of sufficient strength to overcome the strength of the tag's removable attachment to the carrier portion of the sheet when one of the at least one objects is inserted through the aperture from the first end to the contact point of the at least one object or when the aperture is slipped over the first end to the contact point of the at least one object;

a vial rack having at least one aperture for receiving at least one vial; and a means for removably attaching at least one of the at least one sheets to the vial rack.

28. The system of claim 27, wherein the sheet is dimensioned so as to allow placement of the sheet on top of the vial rack such that the aperture in at least one of the tags aligns with one of the at least one apertures in the vial rack.

29. A system for labeling at least one three-dimensional object, each object having a first end and a second end defining a longitudinal axis therebetween, each object further having between the first end and the second end a desired contact point and a desired planar cross-section intersecting the desired contact point of the object defining a contact point surface of the object, each object so dimensioned that at each point between the first end and the desired contact point of the object the area of the planar cross-section of the object with the least cross-sectional area is not substantially greater than the area of the contact point surface of the object, the system comprising:

at least one sheet, the sheet having a carrier portion and at least one tag removably attached to the carrier portion, each of the tags having an aperture therethrough, the aperture dimensioned so that an engagement forms between the aperture and one of the objects at the contact point of the object which is of sufficient strength to overcome the strength of the tag's removable attachment to the carrier portion of the sheet when one of the at least one objects is inserted through the aperture from the first end to the contact point of the at least one object or when the aperture is slipped over the first end to the contact point of the at least one object;

a vial carousel; and a means for removably attaching at least one of the at least one sheets to the vial carousel.

30. The system of claim 29, wherein the sheet is dimensioned so as to allow placement of the sheet on top of the vial carousel such that the aperture in at least one of the tags aligns with one of the at least one apertures in the vial carousel.

31. A system for labeling at least one three-dimensional object, each object having a first end and a second end defining a longitudinal axis therebetween, each object further having between the first end and the second end a desired contact point and a desired planar cross-section intersecting the desired contact point of the object defining a contact point surface of the object, each object so dimensioned that at each point between the first end and the desired contact point of the object the area of the planar cross-section of the object with the least cross-sectional area is not substantially greater than the area of the contact point surface of the object, the system comprising:

at least one sheet, the sheet having a carrier portion and at least one tag removably attached to the carrier portion, each of the tags having an aperture therethrough, the aperture dimensioned so that an engagement forms between the aperture and one of the objects at the contact point of the object which is of sufficient strength to overcome the strength of the tag's removable attachment to the carrier portion of the sheet when one of the at least one objects is inserted through the aperture from the first end to the contact point of the at least one object or when the aperture is slipped over the first end to the contact point of the at least one object;

a sheet holder; and a means for removably attaching at least one of the at least one sheets to the sheet holder comprising a cover placed on top of at least one of the sheets.

32. The system of claim 25, wherein the means for removably attaching at least one of the at least one sheets to the sheet holder comprises an adhesive.

33. The system of claim 25, wherein the means for removably attaching at least one of the at least one sheets to the sheet holder comprises at least one registration protrusion extending upward from the holder and at least one registration hole formed in the sheet for receipt of the at least one registration protrusion.

34. A method for labeling at least one three-dimensional object, each object having a first end and a second end defining a longitudinal axis therebetween, each object further having between the first end and the second end a desired contact point, a desired planar cross-section intersecting the desired contact point of the object defining a contact point surface of the object, each object so dimensioned that at each point between the first end and the desired contact point of the object the area of the planar cross-section of the object with the least cross-sectional area is not substantially greater than the area of the contact point surface of the object, the method comprising:

providing a sheet, the sheet having a carrier portion and at least one tag removably attached to the carrier portion, each of the tags having an aperture therethrough, the aperture dimensioned so as to permit an engagement between the aperture and one of the objects at the contact point of the object of sufficient strength to overcome the strength of the tag's removable attachment to the carrier portion of the sheet;

providing the three-dimensional object;

inserting the first end of the three-dimensional object into the aperture in one of the at least one tags or placing the aperture in one of the at least one tags over the first end of the three-dimensional object;

moving the three-dimensional object through the aperture toward the first end of the object or moving the at least one tag toward the contact point of the three-dimensional object until the aperture is engaged with the object at the contact point;

moving the three-dimensional object relative to the sheet or moving the sheet relative to the three-dimensional object, thereby removing the at least one tag from the carrier portion of the sheet such that the tag remains attached to the object at the contact point.

35. The method of claim 34, wherein moving the three-dimensional object relative to the sheet comprises moving the three-dimensional object away from the sheet toward the second end of the object.

36. The method of claim 34, wherein moving the three-dimensional object relative to the sheet comprises or moving the second end of the three-dimensional object toward the sheet.

37. The method of claim 34, wherein moving the sheet relative to the three-dimensional object comprises moving the sheet toward the first end of the three-dimensional object.

38. The method of claim 34, wherein moving the sheet relative to the three-dimensional object comprises moving the sheet toward the second end of the three-dimensional object.

39. The method of claim 34, wherein the three-dimensional object is a vial.

40. The method of claim 34, wherein the method is performed by a machine.

41. A method for labeling at least one three-dimensional object, each object having a first end and a second end defining a longitudinal axis therebetween, each object further having between the first end and the second end a desired contact point, a desired planar cross-section intersecting the desired contact point of the object defining a contact point surface of the object, each object so dimensioned that at each point between the first end and the desired contact point of the object the area of the planar cross-section of the object with the least cross-sectional area is not substantially greater than the area of the contact point surface of the object, the method comprising:

providing at least one sheet, each sheet having a carrier portion and at least one tag removably attached to the carrier portion, each of the tags having an aperture therethrough, the aperture dimensioned so as to permit an engagement between the aperture and one of the objects at the contact point of the object of sufficient strength to overcome the strength of the tag's removable attachment to the carrier portion of the sheet;

providing a sheet holder;

removably attaching at least one of the sheets to the sheet holder;

providing at least one three-dimensional object;

inserting the first end of the three-dimensional object into the aperture in one of the at least one tags or placing the aperture in one of the at least one tags over the first end of the three-dimensional object;

moving the three-dimensional object through the aperture toward the first end of the object or moving the at least one tag toward the contact point of the three-dimensional object until the aperture is engaged with the object at the contact point; and moving the three-dimensional object relative to the sheet or moving the sheet relative to the three-dimensional object, thereby removing the at least one tag from the carrier portion of the sheet such that the tag remains attached to the object at the contact point.

42. The method of claim 41, wherein moving the three-dimensional object relative to the sheet comprises moving the three-dimensional object away from the sheet toward the second end of the object.

43. The method of claim 41, wherein moving the three-dimensional object relative to the sheet comprises or moving the second end of the three-dimensional object toward the sheet.

44. The method of claim 41, wherein moving the sheet relative to the three-dimensional object comprises moving the sheet toward the first end of the three-dimensional object.

45. The method of claim 41, wherein moving the sheet relative to the three-dimensional object comprises moving the sheet toward the second end of the three-dimensional object.

46. The method of claim 41, wherein removably attaching at least one of the sheets to the sheet holder comprises placing at least one of the sheets on the sheet holder and placing a cover on top of at least one of the sheets.

47. The method of claim 41, wherein removably attaching at least one of the sheets to the sheet holder comprises adhering at least one of the sheets to the sheet holder with an adhesive.

48. The method of claim 41, wherein removably attaching at least one of the sheets to the sheet holder comprises placing at least one registration hole formed in the sheet over at least one registration protrusion extending upward from the sheet holder.

* * * * *